US009702539B2

(12) United States Patent
Scarlata et al.

(10) Patent No.: US 9,702,539 B2
(45) Date of Patent: Jul. 11, 2017

(54) FLOW-THROUGH LUMINAIRE

(71) Applicants: Andrew Francis Scarlata, West Monroe, NY (US); Alexander Michael Frenkel, Seattle, WA (US)

(72) Inventors: Andrew Francis Scarlata, West Monroe, NY (US); Alexander Michael Frenkel, Seattle, WA (US)

(73) Assignee: Cooper Technologies Company, Houston, TX (US)

( * ) Notice: Subject to any disclaimer, the term of this patent is extended or adjusted under 35 U.S.C. 154(b) by 67 days.

(21) Appl. No.: 14/520,094

(22) Filed: Oct. 21, 2014

(65) Prior Publication Data

US 2016/0109111 A1 Apr. 21, 2016

(51) Int. Cl.

| | |
|---|---|
| ***F21V 29/00*** | (2015.01) |
| ***F21V 29/77*** | (2015.01) |
| ***F21V 29/74*** | (2015.01) |
| *F21V 5/04* | (2006.01) |
| *F21V 31/00* | (2006.01) |
| *F21Y 103/33* | (2016.01) |
| *F21Y 115/10* | (2016.01) |

(52) U.S. Cl.

CPC ..... *F21V 29/773* (2015.01); *F21V 29/74* (2015.01); *F21V 5/04* (2013.01); *F21V 31/005* (2013.01); *F21Y 2103/33* (2016.08); *F21Y 2115/10* (2016.08)

(58) Field of Classification Search

CPC ..... F21V 29/74–29/78

See application file for complete search history.

(56) References Cited

U.S. PATENT DOCUMENTS

| | | | |
|---|---|---|---|
| 7,549,774 | B2 | 6/2009 | Tsai |
| 7,663,229 | B2 | 2/2010 | Lu et al. |
| 7,682,049 | B2 | 3/2010 | Zheng et al. |
| 7,871,184 | B2 | 1/2011 | Peng |
| 7,972,036 | B1 | 7/2011 | Schach et al. |
| 7,992,624 | B2 | 8/2011 | Huang |
| 8,018,136 | B2 | 9/2011 | Gingrich, III et al. |
| 8,052,304 | B2 | 11/2011 | Yang et al. |
| D659,890 | S | 5/2012 | Kong et al. |
| D681,259 | S | 4/2013 | Kong |

(Continued)

FOREIGN PATENT DOCUMENTS

| | | | |
|---|---|---|---|
| CN | 202813299 | U | 3/2013 |
| CN | 103486454 | A | 1/2014 |

(Continued)

OTHER PUBLICATIONS

Acuity Brands Lighing Inc., Holophane Leader in Lighting Solutions, Phuzion LED High Bay ordering form data sheet, Jun. 30, 2014, 4 pages, Acuity Brands Lighting, Inc., Granville, Ohio.

(Continued)

*Primary Examiner* — Sean Gramling
(74) *Attorney, Agent, or Firm* — King & Spalding LLP

(57) ABSTRACT

A housing for a luminaire is disclosed herein. The housing can include a central portion forming a substantially closed shape and having an inner area therewithin, where the central portion is thermally conductive. The central portion can include an upper end and a lower end adjacent to the upper end. The housing can also include a number of fins thermally coupled to and extending inward and outward away from the upper end of the central portion, where the plurality of fins are thermally conductive.

20 Claims, 7 Drawing Sheets

(56) References Cited

U.S. PATENT DOCUMENTS

| | | | | |
|---|---|---|---|---|
| 8,419,220 | B2 | 4/2013 | Kong | |
| 8,573,802 | B2 | 11/2013 | Hong et al. | |
| 8,602,599 | B2 | 12/2013 | Zimmer et al. | |
| 8,616,714 | B2 | 12/2013 | Lee et al. | |
| 8,686,623 | B2 | 4/2014 | Wheelock et al. | |
| 2009/0237927 | A1* | 9/2009 | Zheng | F21S 2/005 362/235 |
| 2010/0282446 | A1 | 11/2010 | Yamamoto et al. | |
| 2010/0328948 | A1* | 12/2010 | Mo | F21S 8/04 362/249.02 |
| 2011/0114296 | A1* | 5/2011 | Horng | H01L 23/467 165/104.34 |
| 2011/0232886 | A1 | 9/2011 | Liang | |
| 2012/0212945 | A1 | 8/2012 | Frank | |
| 2013/0044478 | A1 | 2/2013 | Steedly | |
| 2013/0088848 | A1 | 4/2013 | Lee et al. | |
| 2014/0036509 | A1 | 2/2014 | Hong et al. | |

FOREIGN PATENT DOCUMENTS

| | | |
|---|---|---|
| EP | 2206945 | 7/2010 |
| KR | 101127081 | 3/2012 |
| RU | 2200275 | 3/2003 |
| RU | 2418345 | 5/2011 |
| TW | 201326659 | 7/2013 |
| WO | 2009146599 | 12/2009 |

OTHER PUBLICATIONS

E. Lukashina, International Search Report and Written Opinion issued in International Application No. PCT/US2015/056379, completion date Jan. 12, 2016, mailing date Feb. 4, 2016.

Machine Translation of CN202813299U, via LexisNexis Total Patent, 6 pages.

Machine Translation of CN2103486454A, via LexisNexis Total Patent, 9 pages.

Machine Translation of WO2009146599, via LexisNexis Total Patent, 7 pages.

Machine Translation of RU2418345, via LexisNexis Total Patent, 10 pages.

Machine Translation of RU2200275, via LexisNexis Total Patent, 9 pages.

* cited by examiner

FLOW-THROUGH LUMINAIRE

TECHNICAL FIELD

Embodiments of the invention relate generally to luminaires, and more particularly to systems, methods, and devices for cooling luminaires.

BACKGROUND

Luminaires often include one or more heat-generating components, such as light sources and power converters. Dissipating the heat generated by these heat-generating components is important to maintaining reliability of the luminaire. In addition, luminaires can be located in hazardous or marine environments that make reliability of the luminaire even more critical, as one or more applicable standards may need to be met in order for a luminaire to be used in such an environment.

SUMMARY

In general, in one aspect, the disclosure relates to a housing for a luminaire. The housing can include a central portion forming a substantially closed shape and having an inner area therewithin, where the central portion is thermally conductive. The central portion of the housing can include an upper end and a lower end adjacent to the upper end, where the lower end includes at least one light engine assembly coupling feature that is configured to couple to at least one light engine assembly. The housing can also include a number of fins thermally coupled to and extending inward and outward away from the upper end of the central portion, where the fins are thermally conductive.

In another aspect, the disclosure can generally relate to a luminaire. The luminaire can include a housing. The housing of the luminaire can include a central portion forming a substantially closed shape and having an inner area therewithin, where the central portion is thermally conductive. The central portion of the housing of the luminaire can include an upper end and a lower end adjacent to the upper end, where the lower end includes at least one light engine assembly coupling feature. The housing of the luminaire can also include a number of fins thermally coupled to and extending inward and outward away from the upper end of the central portion, where the fins are thermally conductive. The luminaire can also include at least one light engine assembly mechanically coupled to the lower end of the central portion using the at least one light engine assembly coupling feature, where the at least one light engine assembly includes at least one light board and at least one light source. The luminaire can further include at least one electrical conductor electrically coupled to the at least one light engine assembly, where the at least one electrical conductor is coupled to the first power transfer coupling feature.

These and other aspects, objects, features, and embodiments will be apparent from the following description and the appended claims.

BRIEF DESCRIPTION OF THE DRAWINGS

The drawings illustrate only example embodiments of flow-through luminaires and are therefore not to be considered limiting of its scope, as flow-through luminaires may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
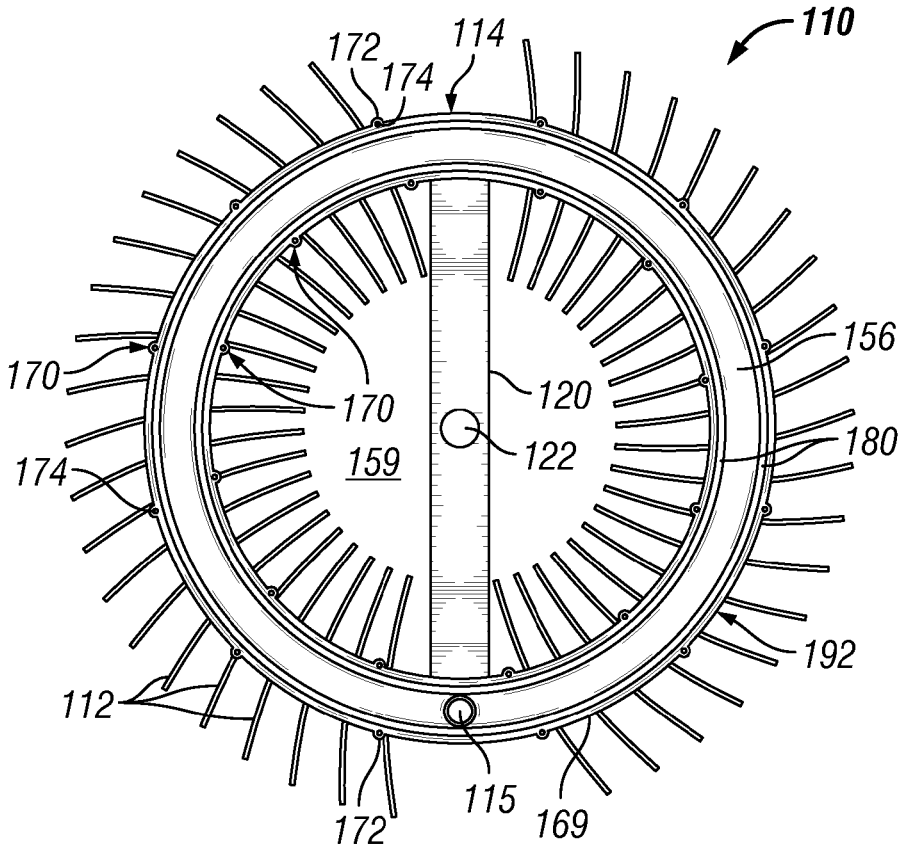
FIGS. 1A and 1B show various views of a housing in accordance with certain example embodiments.

The example embodiments discussed herein are directed to systems, apparatuses, and methods of flow-through luminaires. While the example flow-through luminaires described herein are directed toward a light source that includes one or more light-emitting diodes (LEDs), light sources of example flow-through luminaires are not limited to LEDs. Examples of other light sources that can be used with example flow-through luminaires can include, but are not limited to, incandescent, halogen, fluorescent, and sodium vapor. Also, while example embodiments of a housing are shown to be circular, example housings can be any of a number of other shapes that are closed or substantially closed. Examples of such other shapes can include, but are not limited to, square, triangular, rectangular, oval, and hexagonal. Thus, example embodiments of a housing are not limited to circular shapes.

Any example flow-through luminaire, or portions (e.g., features) thereof, described herein can be made from a single piece (as from a mold). When an example flow-through luminaire or portion thereof is made from a single piece, the single piece can be cut out, bent, stamped, and/or otherwise shaped to create certain features, elements, or other portions of a component. Alternatively, an example flow-through luminaire (or portions thereof) can be made from multiple pieces that are mechanically coupled to each other. In such a case, the multiple pieces can be mechanically coupled to each other using one or more of a number of coupling methods, including but not limited to adhesives, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, or other similar terms. Such terms are merely meant to distinguish various elements and/or features within a component or device and are not meant to limit the capability or function of that particular element and/or feature. For example, a feature described as a "coupling feature" can couple, secure, fasten, and/or perform other functions aside from merely coupling. In addition, each component and/or feature described herein (including each component of an example flow-through luminaire) can be made of one or more of a number of suitable materials, including but not limited to metal, ceramic, rubber, and plastic.

A coupling feature (including a complementary coupling feature) as described herein can allow one or more components and/or portions of an example flow-through luminaire (e.g., a housing) to become mechanically and/or electrically coupled, directly or indirectly, to another portion (e.g., light engine assembly) of the flow-through luminaire and/or to a mounting surface. A coupling feature can include, but is not limited to, portion of a hinge, an aperture, a recessed area, a protrusion, a slot, a spring clip, a tab, a detent, and mating threads. One portion of an example flow-through luminaire can be coupled to another portion of a flow-through luminaire and/or to a mounting surface by the direct use of one or more coupling features.

In addition, or in the alternative, a portion of an example flow-through luminaire can be coupled to another portion of the flow-through luminaire and/or a mounting surface using one or more independent devices that interact with one or more coupling features disposed on a component of the flow-through luminaire. Examples of such devices can include, but are not limited to, a pin, a hinge, a fastening device (e.g., a bolt, a screw, a rivet), and a spring. One coupling feature described herein can be the same as, or different than, one or more other coupling features described herein. A complementary coupling feature as described herein can be a coupling feature that mechanically couples, directly or indirectly, with another coupling feature.

As described herein, a user can be any person that interacts with example flow-through luminaires or systems that use flow-through luminaires. Examples of a user may include, but are not limited to, an engineer, an electrician, a maintenance technician, an instrumentation and controls technician, a mechanic, an operator, a consultant, a contractor, a plant manager, a homeowner, and a manufacturer's representative.

The example flow-through luminaires described herein can be placed in outdoor environments. In addition, or in the alternative, example flow-through luminaires can be subject to extreme heat, extreme cold, moisture, humidity, high winds, dust, chemical corrosion, and other conditions that can cause wear on the flow-through luminaire or portions thereof. In certain example embodiments, the flow-through luminaire, including any portions thereof, are made of materials that are designed to maintain a long-term useful life and to perform when required without mechanical failure.

In addition, or in the alternative, example flow-through luminaires can be located in hazardous and/or marine environments. Examples of a hazardous location in which example embodiments can be used can include, but are not limited to, an airplane hangar, a drilling rig (as for oil, gas, or water), a production rig (as for oil or gas), a refinery, a chemical plant, a power plant, a mining operation, and a steel mill. Example flow-through luminaires can comply with one or more standards for one or more environments of use, where such standards are established and maintained by one or more authoritative entities, including but not limited to Underwriters Laboratories (UL), the Institute for Electrical and Electronics Engineers (IEEE), the National Electromechanical Manufacturers Association (NEMA), and the International Electrotechnical Commission (IEC).

Example embodiments of flow-through luminaires will be described more fully hereinafter with reference to the accompanying drawings, in which example embodiments of flow-through luminaires are shown. Flow-through luminaires may, however, be embodied in many different forms and should not be construed as limited to the example embodiments set forth herein. Rather, these example embodiments are provided so that this disclosure will be thorough and complete, and will fully convey the scope of flow-through luminaires to those of ordinary skill in the art. Like, but not necessarily the same, elements (also sometimes called components) in the various figures are denoted by like reference numerals for consistency.

Terms such as "first," "second," "end," "inner," "outer," "inside," "outside," "upper," "lower," and "bottom" are used merely to distinguish one component (or part of a component or state of a component) from another. Such terms are not meant to denote a preference or a particular orientation. Also, the names given to various components described herein are descriptive of one or more embodiments and are not meant to be limiting in any way. Those of ordinary skill in the art will appreciate that a feature and/or component shown and/or described in one embodiment (e.g., in a figure) herein can be used in another embodiment (e.g., in any other figure) herein, even if not expressly shown and/or described in such other embodiment.

For any figures described herein, example embodiments (or details thereof) are shown. For each figure, one or more of the components may be omitted, added, repeated, and/or substituted. Accordingly, embodiments captured in such figures should not be considered limited to the specific arrangements of components shown in that figure. In addition, any component described in a figure herein can apply to a corresponding component having a similar label in another figure herein. In other words, the description for any component of one figure can be considered substantially the same as the corresponding component described with respect to another figure.

Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number and corresponding components in other figures have the identical last two digits.

Figure 1B:
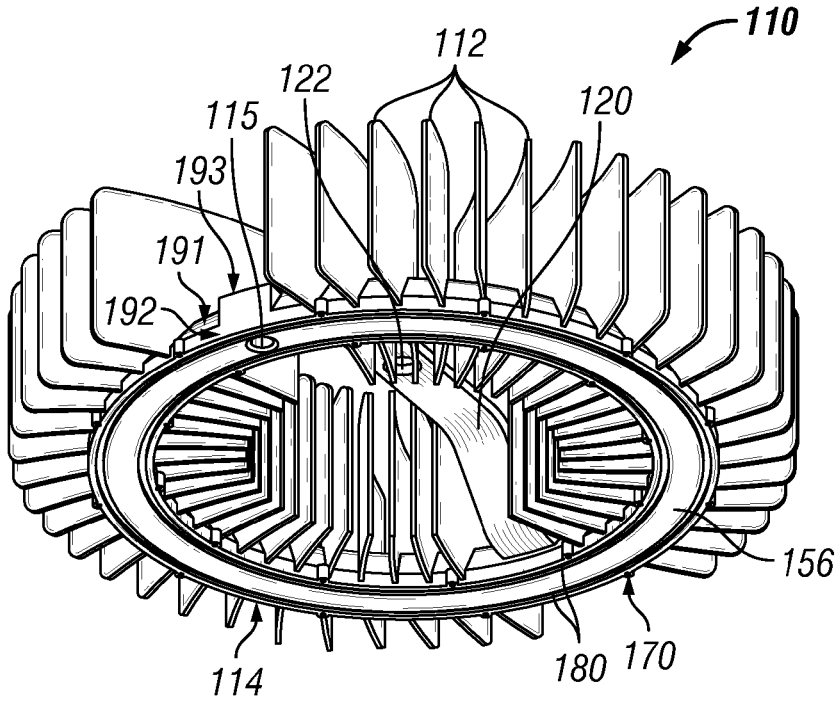

FIGS. 1A and 1B show a bottom view and a bottom-side perspective view, respectively, of a housing 110 for a luminaire in accordance with certain example embodiments. Referring to FIGS. 1A and 1B, the housing 110 can have a central portion 114, a number of fins 112, and a bracket 120. The central portion 114 and the fins 112 can be made of one or more of a number of thermally conductive materials, including but not limited to aluminum and steel. The central portion 114 can be made of the same materials as, or different materials than, the material of the fins 112. The central portion 114 and the fins 112 are thermally coupled to each other. In other words, the housing 110 can act as a heat sink.

In certain example embodiments, the central portion 114 of FIGS. 1A and 1B has a substantially circular shape when viewed from below. Alternatively, the central portion 114 can have one or more other shapes when viewed from below. Such other shapes can include, but are not limited to, an oval, a square, a rectangle, and a triangle. The central portion 114 can have an upper end 191 and a lower end 192. The lower end 192 can include one or more of a number of features. For example, as shown in FIGS. 1A and 1B, the lower end 192 can include at least one light engine assembly coupling feature 170. In such a case, each light engine assembly coupling feature 170 can be used to couple one or more light engine assemblies to the central portion 114. In this case, each light engine assembly coupling feature 170 is a protrusion 172 that extends outward away from the lower end 192 of the central portion 114, where each protrusion 172 has an aperture 174 that traverses therethrough. The light engine assembly coupling features 170 in this case are disposed on both sides (inward-facing side and outward-facing side) of the lower end 192 of the central portion 114.

The light engine assembly coupling features 170 can provide mechanical, electrical, and/or thermal coupling between the light engine assembly and the central portion 114 of the housing 110. The lower end 192 of the central portion 114 of the housing 110 can be oriented in a substantially planar manner. In other words, the bottom surface 156 of the lower end 192 of the central portion 114 can be substantially flat. Further, the bottom surface 156 can be oriented in such a way that, when one or more light engine assemblies are coupled to the light engine assembly coupling features 170, the light engine assemblies are directed in a particular way. For example, as shown below, the light engine assemblies can be directed substantially downward relative to the housing 110. The light engine assemblies can also, or alternatively, be directed in other directions relative to the housing 110.

Another example of a feature of the lower end 192 of the central portion 114 of the housing 110 can be one or more channels 180 disposed in the bottom surface 156. For example, as shown in FIGS. 1A and 1B, the channels 180 can be disposed in some or all of the length (in this case, the circumference) of the bottom surface 156. Each channel 180 can be disposed a certain distance from an edge of the bottom surface 156. In certain example embodiments, each channel 180 can receive a sealing member (e.g., a gasket, an o-ring, silicone). In such a case, as described below with respect to FIG. 8, each sealing member can abut against another component of the luminaire (e.g., a lens) and can be used to help reduce or eliminate the amount of external contaminants (e.g., dirt, moisture, chemicals) that can affect a light engine assembly.

Yet another feature of the lower end 192 of the central portion 114 of the housing 110 can be one or more lens coupling features 169. For example, as shown in FIGS. 1A and 1B, the lens coupling features 169 can be disposed in some or all of the length (in this case, the circumference) of the bottom surface 156 between a channel 180 and an adjacent edge of the bottom surface 156. In this case, the lens coupling features 169 can be detents that allow an optional lens (not shown here, but shown in FIG. 8 below) to snap into place over the bottom surface 156. In addition to the lens coupling features 169, or as an alternative to the lens coupling features 169, the light engine assembly coupling features 170 can be used to couple both a light engine assembly and a lens to the central portion 114 of the housing 110.

In certain example embodiments, the upper end 191 of the central portion 114 of the housing 110 can also include one or more of a number of features. For example, as shown in FIGS. 1A and 1B, the upper end 191 can include at least one power transfer coupling feature 193. The power transfer coupling feature 193 can be configured to couple to an electrical cable or other means of transferring power from a power converter or a power supply to a light engine assembly coupled to the lower end 192 of the central portion 114 of the housing 110.

In this example, the power transfer coupling feature 193 includes an aperture 115 that extends through at least a portion of the central portion 114 of the housing 110. To the extent that the aperture 115 extends completely through the central portion 114 of the housing 110, the aperture 115 can be disposed in the bottom surface 156 of the lower end 192 of the central portion 114. The power transfer coupling feature 193 can be positioned at a location along the upper end 191 that is proximate to where the bracket 120 couples to the central portion 114 of the housing 110.

In certain example embodiments, the upper end 191 and the lower end 192 of the central portion 114 can have a shape when viewed cross-sectionally (as shown, for example, in FIGS. 7-9 below). The cross sectional shape of the upper end 191 can be the same as, or different than, the cross-sectional shape of the lower end 192. For example, the cross-sectional shape of the upper end 191 can be triangular, while the cross-sectional shape of the lower end 192 can be rectangular. Other cross-sectional shapes of the upper end 191 and/or the lower end 192 can include, but are not limited to, semi-circular, semi-elliptical, sawtooth, semi-hexagonal, and irregular.

In certain example embodiments, the upper end 191 and the lower end 192 can be a solid piece. Alternatively, the upper end 191 and/or the lower end 192 can be hollow, forming a cavity within. In such a case, the cavity can be used to allow one or more components of the luminaire to be disposed therein. For example, one or more electrical cables, electrical conductors, and/or electrical connectors can be disposed within the cavity within the central portion 114 of the housing 110. If a cavity exists within the central portion 114 of the housing 110, the cavity can be continuous throughout the central portion 114 or be disposed within one or more discrete portions of the central portion 114. If the upper end 191 and/or the lower end 192 is a solid piece, then one or more components (e.g., electrical conductors, electrical connectors) of the luminaire can be fixed within and integral with the upper end 191 and/or the lower end 192.

The fins 112 of the housing 110 can be thermally coupled to at least some portion (e.g., the upper end 191) of the central portion 114 of the housing 110. In this example, as shown in FIGS. 1A and 1B, the fins 112 are coupled to and extend away from both the upper end 191 and the lower end 192 of the central portion 114. The fins 112 can be straight (planar), curved, angled, irregularly shaped, and/or have any other feature along its length. One fin 112 can have substantially the same characteristics (e.g., length, width, shape, thickness) as, or different characteristics than, the corresponding characteristics of one or more of the other fins 112. The fins 112 can be positioned in such a manner that each fin 112 avoids direct physical contact with any other (e.g., adjacent) fins 112 and/or the bracket 120. For example, as shown in FIGS. 1A and 1B, there can be a gap in the fins 112 where the bracket 120 couples to opposite sides of the central portion 114.

In certain example embodiments, as shown in FIGS. 1A and 1B, the fins 112 are coupled to and extend away from the upper end 191 and/or the lower end 192 of the central portion 114 of the housing 110. In extending away from the central portion 114 of the housing 110, the fins 112 can extend upward (away from the upper end 191), outward, and/or inward. As shown in FIGS. 1A, 1B, and 9, the area (defined by the length and the width) of a fin 112 can be substantially larger than the cross-sectional area of the central portion 114.

A fin 112 can extend inward and/or outward from the central portion 114 in any amount or proportion. For example, a fin 112 can extend inward from the central portion 114 by substantially the same amount as the fin 112 extends outward from the central portion 114. In other words, a fin 112 can be vertically centered with respect to the central portion 114. In certain example embodiments, each fin 112 extends inward and outward from the central portion 114 by some amount to induce air flow around both the inside and the outside of the central portion 114.

Figure 2:
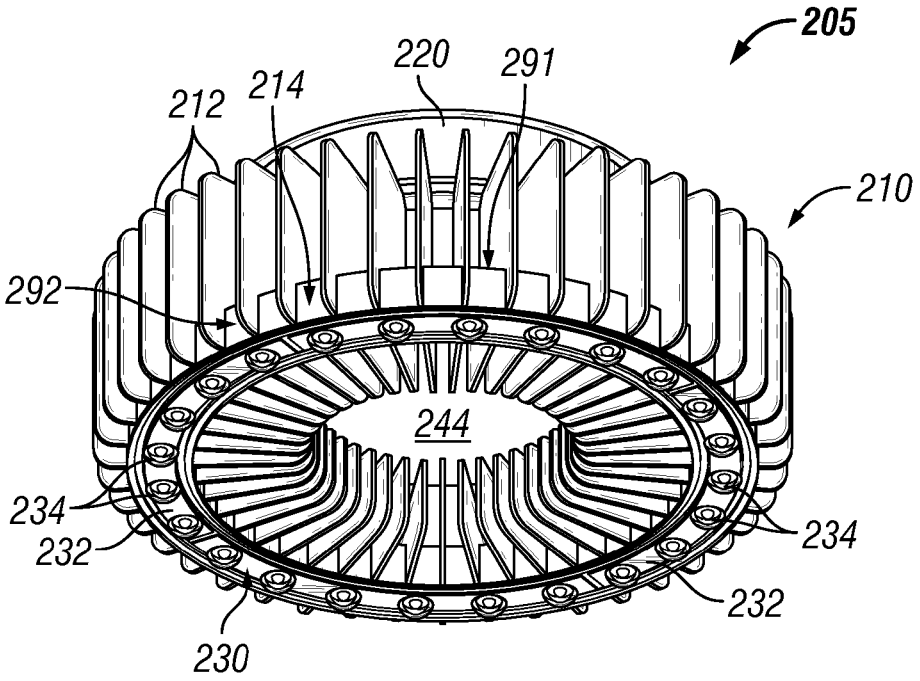
FIG. 2 shows a luminaire in accordance with certain example embodiments.
Figure 4A:
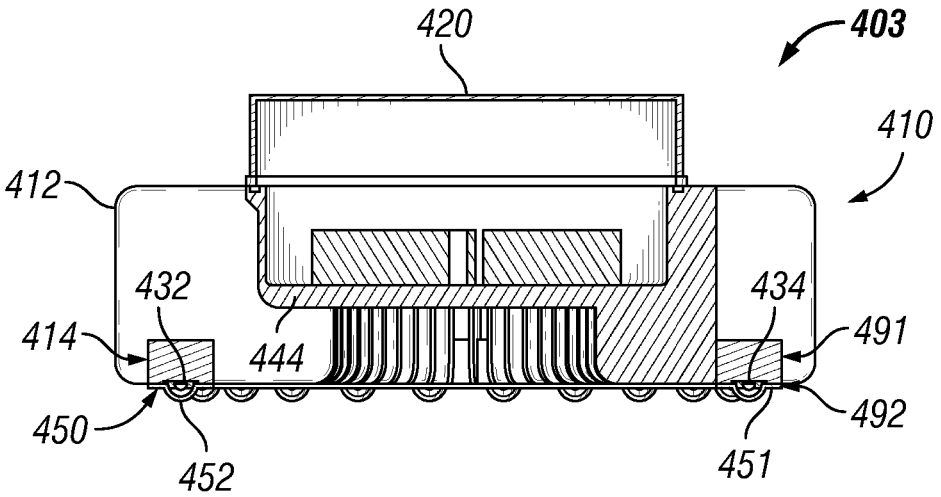
FIGS. 4A and 4B show various views of yet another luminaire in accordance with certain example embodiments.
Figure 4B:
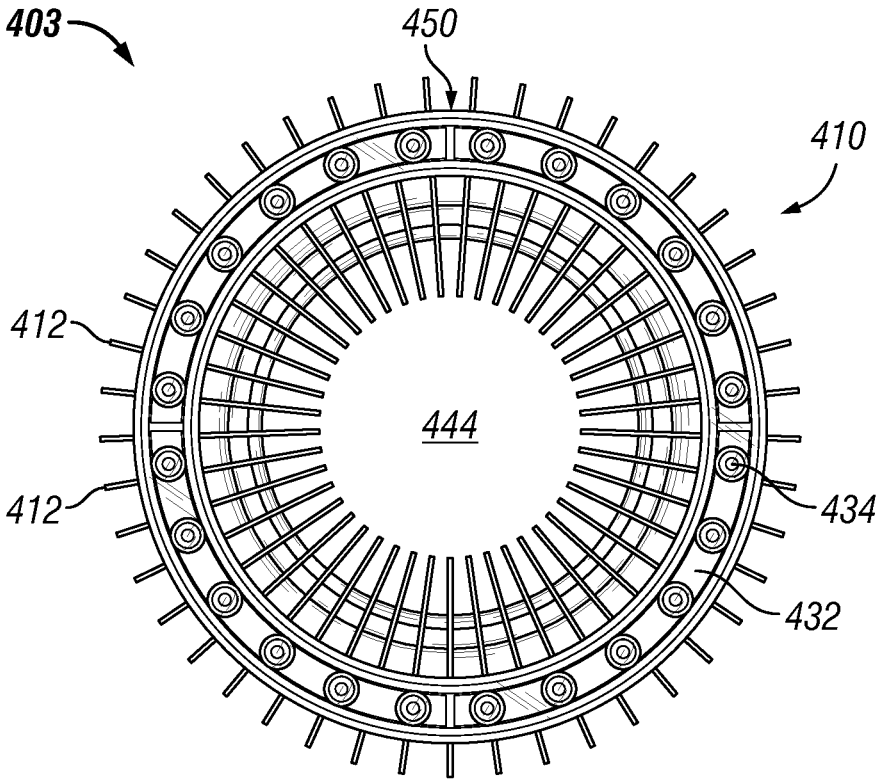

In certain example embodiments, the bracket 120 of the housing 110 is coupled to the central portion 114 of the housing 110. Further, the bracket 120 can traverse at least a portion of the inner area 159 defined by the central portion 110 when viewed from above or below. The bracket 120 can have any of a number of shapes. For example, as shown in FIGS. 1A and 1B, the bracket 120 can be a strip. The bracket 120 can also have any of a number of other suitable shapes and/or configurations. For example, as shown in FIGS. 2, 4A, and 4B, the bracket 120 can be a type of enclosure into which a power converter can be disposed. The bracket 120 can include one or more features. For example, as shown in FIGS. 1A and 1B, the bracket can include at least one mounting feature 122, which is a coupling feature that allows the bracket 120 (and, thus, the housing 110) to couple, directly or indirectly, to an external mounting component (e.g., a beam, a stem, a conduit). In this case, the mounting feature 122 is an aperture positioned in the approximate center (lengthwise and width-wise) of the bracket 120 and that traverses the entire thickness of the bracket 120.

Figure 6A:
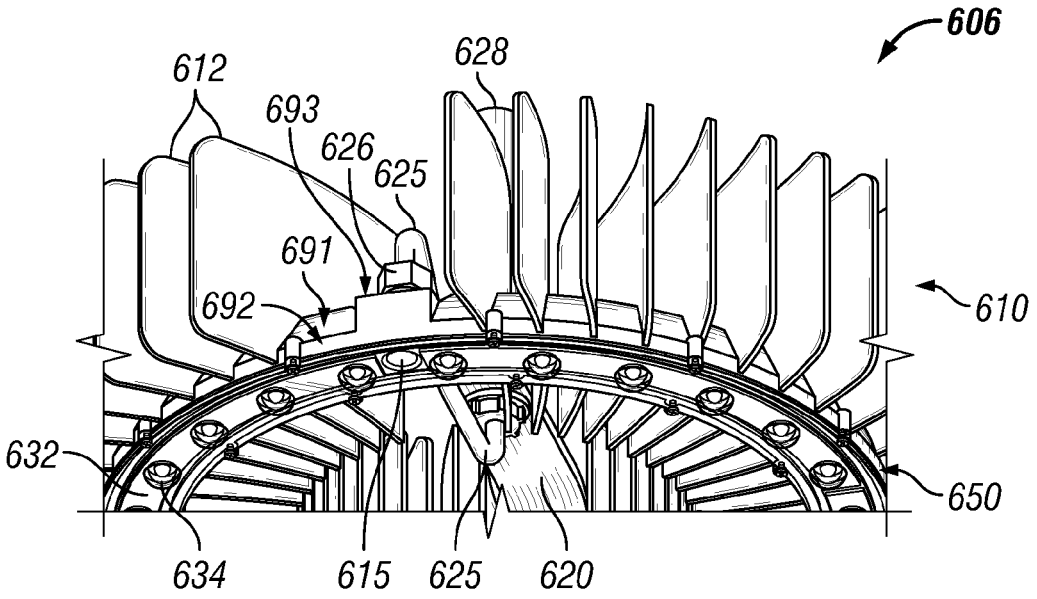
FIGS. 6A and 6B show yet another luminaire in accordance with certain example embodiments.
Figure 6B:
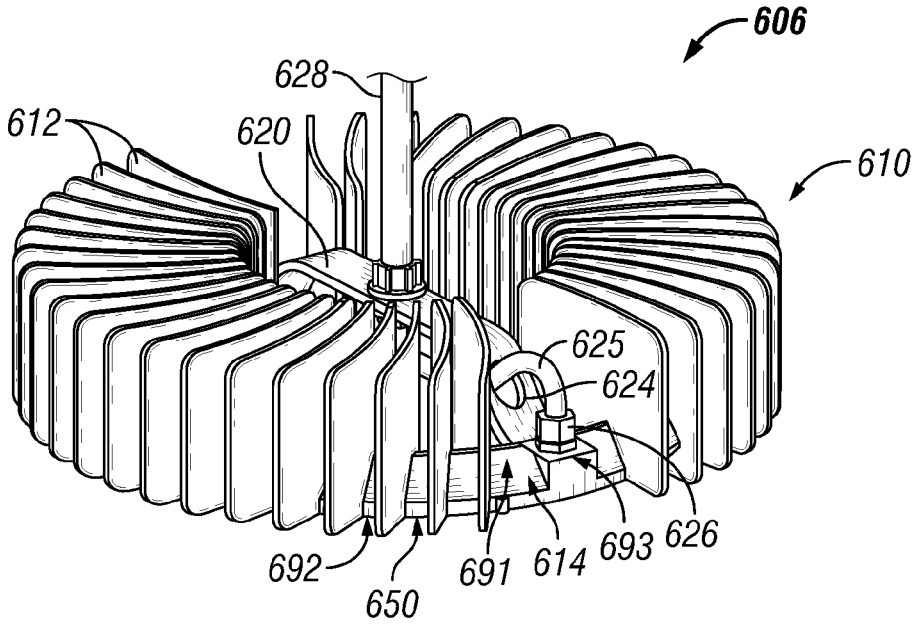

As another example of a feature of the bracket 120, as shown in FIG. 6B, the bracket 120 can include a power transfer coupling feature 624. As yet another example of a feature of the bracket, the bracket 120 can also, in certain example embodiments, have a coupling feature (e.g., coupling feature 120) to couple a power converter (e.g., a LED driver, a ballast) to the bracket 120. An example of this is shown in FIG. 2 below.

FIG. 2 shows a luminaire 205 in accordance with certain example embodiments. Specifically, the luminaire 205 of FIG. 2 includes a housing 210 (substantially similar to the housing of FIGS. 1A and 1B, except as described below), multiple light engine assemblies 230, and a power converter 244. The housing 210 of FIG. 2 differs from the housing 110 of FIGS. 1A and 1B in that the fins 212 of FIG. 2 are straight (planar, with no curvature).

Also, the bracket 220 in this case is a housing for a power converter 244. The bracket 220 is coupled to the top end of the fins 212 rather than to the central portion 214 of the housing 210. Consequently, the fins 212 are disposed equidistantly around all of the central portion 214 of the housing 210. In addition, the cross-sectional shape and size of the upper end 291 is substantially the same as the cross-sectional shape and size of the lower end 292 of the central portion 214.

Figure 3:
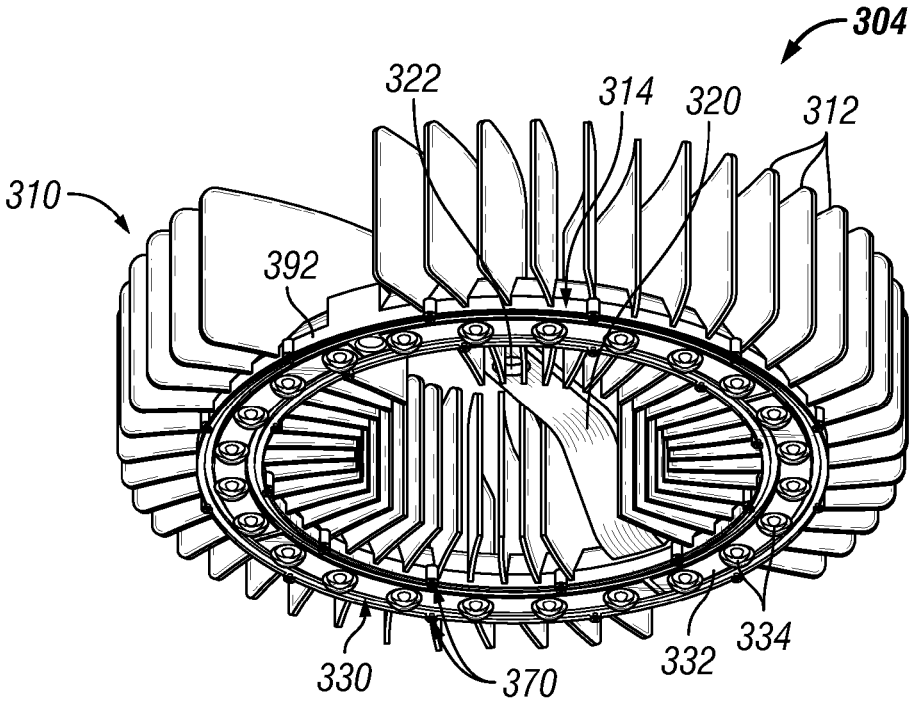
FIG. 3 shows another luminaire in accordance with certain example embodiments.

The power converter 244 can be a direct source of power (e.g., a battery). Alternatively, the power converter 244 can receive power from a remote power supply (e.g., an alternating current (AC) circuit) and manipulate (e.g., transform, invert, convert) the power to some other type and/or amount that is used by the light engine assemblies 230. When the type and amount of power delivered by a remote power supply is the same as the type and amount of power used by the light engine assemblies, as shown in FIG. 3 below, then the luminaire does not have a power converter.

In this example, with the power converter 244, the fins 112 create a physical separation between the power converter 244 and the light engine assemblies 230. This feature is important because both the power converter 244 and the light engine assemblies 230 can generate significant heat when operating. Thus, using example embodiments, the housing 210 (and, specifically, the configuration of the central portion 214 and the fins 212) allow air to naturally flow through the luminaire 205 to remove heat from both the power converter 244 and the light engine assemblies 230. Specifically, air flows around the light engine assemblies 230, both on the inside (the portion of the central portion 214 that defines and faces the inner area 259) and the outside (the portion of the central portion 214 outside of and facing away from the inner area 259) of the central portion 214 of the housing 210, and through the fins 212.

A luminaire can have one or more light engine assemblies. For example, as shown in FIG. 2, the luminaire 205 has four light engine assemblies 230 that are each of the substantially same size and shape (e.g., a ¼ circle). In certain example embodiments, each light engine assembly 230 of the luminaire 205 includes a circuit board 232 and at least one light source 234. The circuit board 232 can be a medium that includes, and on which are disposed, one or more of a number of discrete components (e.g., a capacitor, a power terminal, a resistor, a light source 271) and/or one or more integrated circuits that are interconnected with each other by a number of wire traces embedded in the circuit board 232. The circuit board 232 can be called one or more of a number of other names, including but not limited to a board, a wiring board, a circuit board, printed wiring board, and a printed circuit board.

As discussed above, a light source 234 can use any of a number of different types of lighting technologies, including but not limited to LED, incandescent, halogen, fluorescent, and sodium vapor. If the light source 234 uses LED technology, the light source can be any type of LED, including but not limited to chip-on-board, discrete, and array. Further, a light source 234 can emit one or more of a number of colors (e.g., white, red, green, blue) in one or more of a number of modes (e.g., constant, flashing, intermittent, color transitions). For example, the light source 234 can be a tricolor LED that is capable of emitting red light, green light, blue light, and/or light with any combination thereof. In certain example embodiments, a control module (not shown, but could be located, for example, remotely with respect to the luminaire 205, on the circuit board 232, or in the bracket 220) can be operatively coupled to one or more of the light engine assemblies 230 and control the operation mode of one or more light sources 234.

The light engine assemblies 230 of FIG. 2 are coupled to the central portion 214 of the housing 210. In this case, the light engine assembly coupling features 270 used to couple the light engine assemblies 230 to the central portion 214 of the housing 210 are hidden from view in FIG. 2. Such light engine assembly coupling features 270 can include, but are not limited to, clips, electrical connectors, detents, and tabs. The light engine assembly coupling features 270 can provide mechanical, electrical, and thermal coupling between the light engine assemblies 230 and the central portion 214 of the housing 210.

FIG. 3 shows a portion of another luminaire 304 in accordance with certain example embodiments. Specifically, the luminaire 304 of FIG. 3 includes a housing 310 that is substantially similar to the housing 110 of FIGS. 1A and 1B and four light engine assemblies 330 that are substantially similar to the light engine assemblies 230 of FIG. 2. In this case, the luminaire 304 does not have a power converter. In other words, the luminaire 304 can use the same type and amount of power (e.g., 120 VAC) that is delivered to the luminaire 304 from a remote power supply. In such a case, the power can be delivered by an electrical cable (not shown in FIG. 3, but is shown in FIGS. 6A and 6B below.

FIGS. 4A and 4B show yet another luminaire 403 in accordance with certain example embodiments. Specifically, the luminaire 403 of FIGS. 4A and 4B is substantially similar to the luminaire 205 of FIG. 2. FIGS. 4A and 4B show how the example housing 410 (and, specifically, the configuration of the central portion 414 and the fins 412) provides physical separation between the power converter 444 and the light engine assemblies 430. Consequently, the configuration of the central portion 414 and the fins 412 allows for natural air flow through the luminaire 403 (as well as around the outer portions of the central portion 414 of the housing 410) to remove heat from both the power converter 444 and the light engine assemblies 430.

In addition, FIGS. 4A and 4B show the optional lens 450 coupled to the housing 410. The lens 450 is an optical device that can be disposed over some or all of the light engine assemblies 430. For example, as shown in FIGS. 4A and 4B, the lens 450 can be disposed over the light boards 432 and the light sources 434. Alternatively, the lens 450 can be disposed over only the light sources 434. The lens 450 can have a number of features that allow the lens to reflect, refract, filter, and/or otherwise manipulate the light emitted by the light sources 434. As discussed above, the lens 450 can be directly or indirectly coupled to the central portion 414 of the housing 410 using one or more lens coupling features disposed on the central portion 414 of the housing 410. In this case, the lens coupling features are slots (hidden from view), which receive tabs (also hidden from view) that protrude upward from the lens 450.

Figure 5:
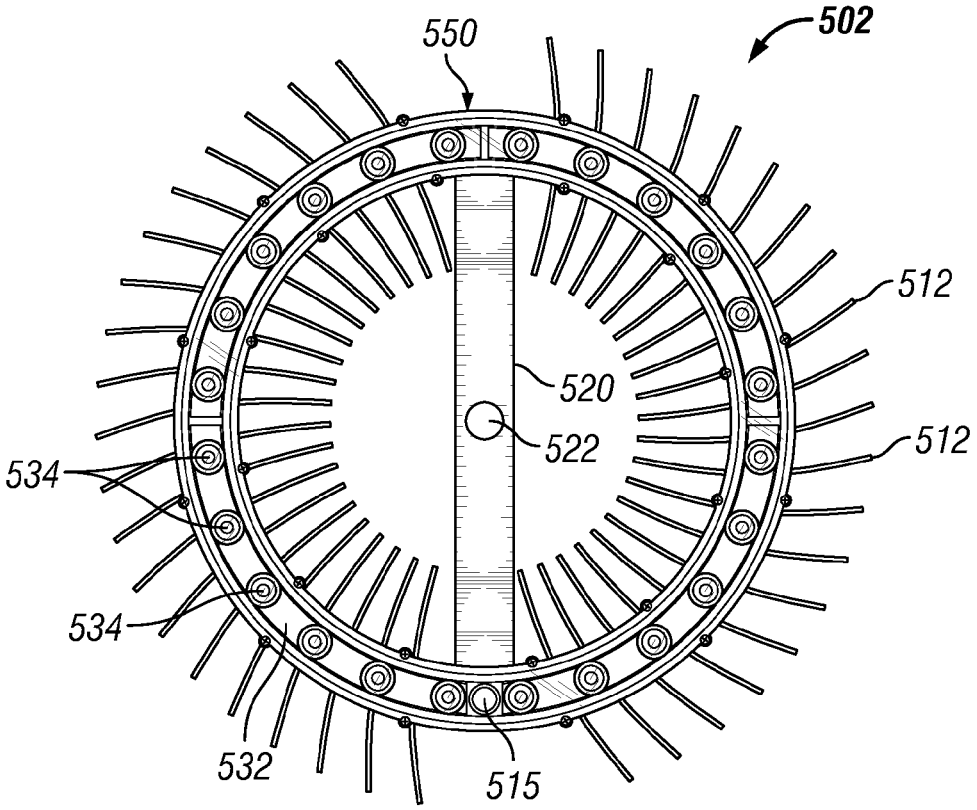
FIG. 5 shows still another luminaire in accordance with certain example embodiments.

FIG. 5 shows still another luminaire 502 in accordance with certain example embodiments. Specifically, the luminaire 502 of FIG. 5 includes a housing 510 and a number of light engine assemblies 530 that are substantially similar to the housing 310 and light engine assemblies 330 of FIG. 3, and also includes an optional lens 550 that is substantially similar to the lens 450 of FIGS. 4A and 4B.

FIGS. 6A and 6B show yet another luminaire 606 in accordance with certain example embodiments. Specifically, the luminaire 606 includes a housing 610, lens 650, and light engine assemblies 630 that are substantially similar to the housing 510, lens 550, and light engine assemblies 530 of FIG. 5. In addition, a mounting component 628 is shown coupled to the mounting feature 622 (hidden from view) of the bracket 620. The mounting component 628 in this case is a rigid conduit having a wall that forms a cavity. In such a case, an electrical cable 625 can be disposed within the cavity of the mounting component. Thus the mounting component 628 can provide a mounting structure for the luminaire 606 to a mounting surface, as well as provide a protective path for the electrical cable 625 to couple to the luminaire 606. Other examples of a mounting component 628 can include, but are not limited to, a beam and a stem.

In addition to the mounting feature 622, the bracket 620 can include a power transfer coupling feature 624 that traverses the bracket 620. In this case, the power transfer coupling feature 624 allows the electrical cable 625 to traverse therethrough so that the electrical cable 625 can be held in place proximate to where the electrical cable 625 couples to the power transfer coupling feature 693 disposed in the upper end 691 of the central portion 614 of the housing 610.

One or more of a number of coupling devices 626 can be used to hold the electrical cable 625 in place at the power transfer coupling feature 693 and at the mounting component 628. For example, in this case, the coupling device 626 is a threaded fitting. By connecting the electrical cable 625 to the power transfer coupling feature 693, electric power can be transferred through the electrical cable 625, through electrical connections (e.g., electrical conductors, electrical connectors) internal to the central portion 614 of the housing 610, and to the light engine assemblies 630. The electrical cable 625 can include at least one electrical conductor. The coupling device 626 can be a water-tight fitting, which allows the luminaire 606 to comply with standards for hazardous and/or wet (as opposed to merely damp) environments.

In certain example embodiments, to help accommodate various components (e.g., the electrical cable 625, an optional power converter, the mounting component 628) of the luminaire 606, the bracket 620 can be non-linear. For example, as shown in FIGS. 6A and 6B, the middle portion of the bracket 620 is raised relative to the ends of the bracket 620, where the bracket 620 couples to the central portion 614 of the housing 610. For example, if there was a power converter included in the luminaire 606, the power converter could be mechanically coupled to the raised center portion of the bracket 620 using the power converter coupling feature 622, thermally coupled to the fins 612 of the housing 610, and electrically coupled to the electrical cable 625.

Figure 7:
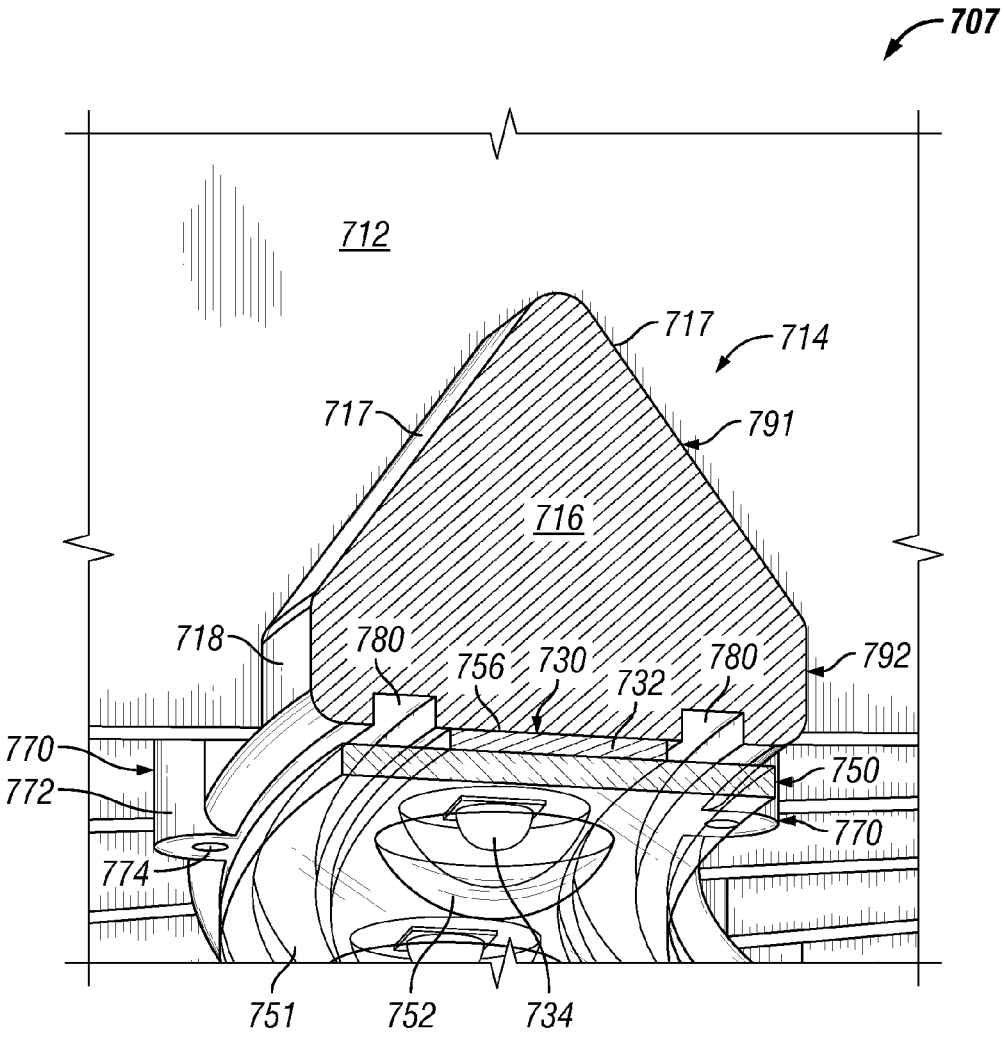
FIGS. 7-9 show various portions of luminaires in accordance with certain example embodiments.

FIG. 7 shows a portion of a luminaire 707 in accordance with certain example embodiments. Specifically, the portion of the luminaire 707 includes a central portion 714, fins 712, a lens 750, and a number of light engine assemblies 730 that are substantially similar to the central portion 614, the fins 612, the lens 650, and the light engine assemblies 630 of FIGS. 6A and 6B. FIG. 7 shows details of the channels 780 and the light engine assembly coupling feature 770. As shown in FIG. 7, the two channels 780 disposed in the bottom surface 756 of the lower end 792 of the central portion 714 are spaced wider than the circuit board 732 of the light engine assembly 730. In this way, when sealing members are positioned within the channels 780, the circuit board 732, along with the rest of the light engine assembly 720, can be protected from external elements.

The lens 750 in this case covers the light engine assemblies 730 and the channels 780. The lens 750 can have a body 751 and one or more protrusions 752. The body 751 corresponds to (covers) the circuit boards 732 and the channels 780 (with or without sealing members). Thus, the surface of the body 751 of the lens 750 that abuts against the circuit boards 732 and, when positioned in the channels 780, the sealing members have a contour that matches, at least, the contour of the circuit boards 732. The protrusions 752 of the lens 750 correspond to (cover) the light sources 734 of the light engine assemblies 730. The protrusions 752 of the lens 750 can have one or more optical features that allow the protrusions 752 to reflect, refract, filter, and/or otherwise manipulate the light generated by the light sources 734.

In this example, the lens 750 can be coupled to the central portion 714 of the housing 710 using snap fittings and/or adhesives. FIG. 7 also shows a detail of the central portion 714 of the housing 710. The upper end 791 has a triangular cross-sectional shape with outer edges 717. The lower end 792 has a rectangular cross-sectional shape with outer edges 718. The fins 712 extend outward from the outer edges 718 of the lower end 792 and from the outer edges 717 of the upper end 791.

Figure 8:
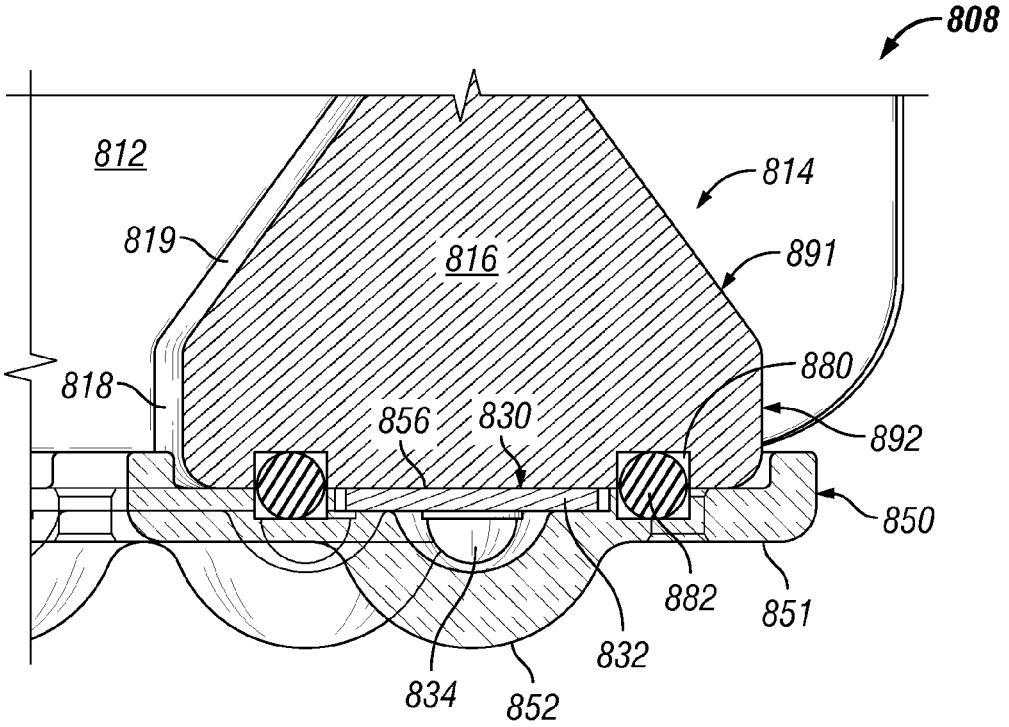

FIG. 8 shows a portion of a luminaire 808 in accordance with certain example embodiments. Specifically, the portion of the luminaire 808 includes a central portion 814, fins 812, and a number of light engine assemblies 830 that are substantially similar to the central portion 714, the fins 712, and the light engine assemblies 730 of FIG. 7. The lens 850 of FIG. 8 is substantially similar to the lens 750 of FIG. 7, except in this case the body 851 of the lens extends inward and outward further than the body 751 of the lens 750. As shown in FIG. 8, the body 851 of the lens 850 extends beyond the channels 880 and the bottom surface 856, and curves upward to follow the contour of the outer edges 818 of the lower end 892.

FIG. 8 also shows sealing members 882 (in this case, gaskets) positioned within the channels 880. The sealing members 882 abut against the body 851 of the lens 850. The sealing members 882 provide ingress protection for the light engine assemblies, and so the sealing members 182 can allow the luminaire 808 to comply with one or more standards. For example, the luminaire 808 can comply with the NEMA 66 standard for marine environments and hose-proof capabilities.

Figure 9:
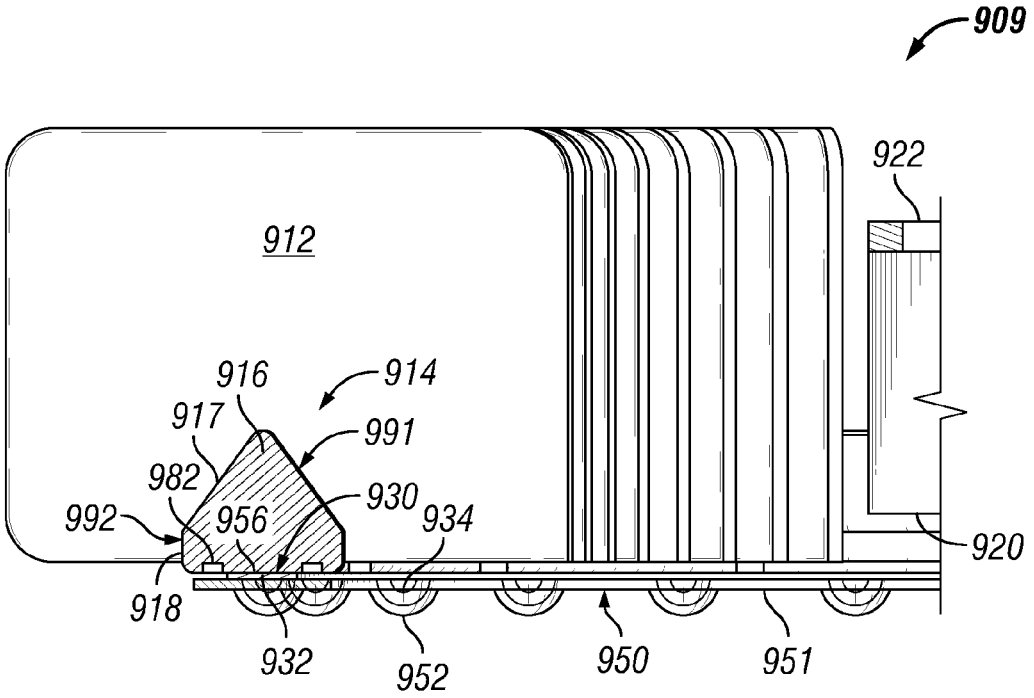

FIG. 9 shows a portion of a luminaire 909 in accordance with certain example embodiments. Specifically, the portion of the luminaire 909 of FIG. 9 includes a central portion 914, fins 912, a number of light engine assemblies 930, a lens 950, and a bracket 920 that are substantially similar to the central portion 814, the fins 812, the light engine assemblies 830, the lens 850, and the bracket 820 of FIG. 8.

These figures, particularly FIGS. 7-9, show how example embodiments can increase or maximize convection heat transfer using the configuration of the central portion and the fins of the housing. Referring to FIG. 9, heat generated by the light engine assemblies 930 is transferred (conducted) to the central portion 914 of the housing 910. This conductance of heat is generally directly proportional to the change in temperature (the temperature difference between the outer surfaces (e.g., outer surface 917, outer surface 918) of the central portion 914 of the housing 910 and the ambient environment) and indirectly proportional to the length of the conduction path (the distance from the light engine assembly 930 to the outer surfaces of the central portion 914 of the housing 910.

The convection heat transfer induced by example embodiments is directly proportional to the surface area of the fins 912 and to the change in temperature. For example, ambient air is drawn upward (with respect to the housing 910) and flows around the light engine assemblies 930, both on the inside and the outside of the central portion 914 of the housing 910, and through the fins 912. This ambient air is cooler than the temperature of the light engine assemblies 930, the central portion 914, and the fins 912, and heat from the light engine assemblies 930, the central portion 914, and the fins 912 are transferred to the ambient air. For the ambient air that passes through the inside of the central portion 914 of the housing 910, can continue passing through the fins 912 and similarly dissipate heat from a power converter if a power converter is locally mounted to the housing 910.

If a power converter is coupled to the housing of the luminaire 909, then the fins 912 serve a substantially similar purpose for dissipating heat generated by the power converter as with the heat generated by the light engine assemblies 930. In certain example embodiments, the efficiency of example flow-through luminaires is increased by maximizing the surface area of the fins 912 while also minimizing the distance between the outer surfaces (e.g., outer surface 917, outer surface 918) of the central portion 914 of the housing 910 and the outer perimeter of the fins 912. Thus, example embodiments can improve convection capacity over luminaires currently known in the art by at least two times. This, in turn, allows for greater power dissipation and reduced size design (luminaire footprint) using example embodiments. As a result of this increased efficiency in heat dissipation, example embodiments can be used in environments with an ambient temperature in excess of 65° C.

The systems and methods described herein allow example flow-through luminaires to be used in hazardous environments and marine environments. Specifically, example embodiments allow luminaires to comply with one or more standards that apply to electrical devices located in such environments. Example embodiments also allow for reduced manufacturing time, materials (e.g., smaller footprint), and costs of luminaires. Example embodiments also provide for increased reliability of because of lower operating temperatures.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A housing for a luminaire, comprising:

a central portion forming a substantially closed shape, wherein the central portion has a first width and a first height, wherein the substantially closed shape forms an inner area therewithin, wherein the inner area is open and traverses a height of the central portion, wherein the central portion is thermally conductive, and wherein the central portion comprises:

an upper end; and a lower end adjacent to the upper end, wherein the lower end comprises at least one light engine assembly coupling feature that is configured to couple to at least one light engine assembly; and a plurality of fins thermally coupled to and extending inward and outward away from the upper end of the central portion, wherein the plurality of fins are thermally conductive, wherein the plurality of fins extending inward are disposed within the inner area, wherein each fin of the plurality of fins has a second width and a second height, wherein the second width is greater than the first width, wherein the second height is greater than the first height, wherein the central portion is positioned substantially halfway along the second width of the plurality of fins, wherein the central portion and the plurality of fins induce natural air flow therethrough, wherein the natural air flow removes heat from the central portion and the plurality of fins without using an air moving device, wherein the natural air flow moves unimpeded through the plurality of fins within the inner area at least to the first height of the central portion, and wherein a bottom inner end of the plurality of fins avoid contact with each other and with another component of the luminaire.

2. The housing of claim 1, further comprising:

a bracket coupled to the central portion and traversing at least some of the inner area of the substantially closed shape when viewed from above, wherein the bracket comprises a mounting feature configured to couple the bracket to an external mounting object.

3. The housing of claim 2, wherein the bracket further comprises a power converter coupling feature configured to couple the bracket to a power converter.

4. The housing of claim 1, wherein the plurality of fins have a curvature.

5. The housing of claim 1, wherein the central portion further comprises a power transfer coupling feature disposed in the upper end of the central portion.

6. The housing of claim 5, wherein the upper end and the lower end of the central portion form a cavity, wherein the cavity is configured to receive at least one electrical conductor disposed in the power transfer coupling feature.

7. The housing of claim 1, wherein the lower end of the central portion further comprises at least one channel disposed therein, wherein the at least one channel is configured to receive at least one sealing member.

8. The housing of claim 1, wherein the lower end of the central portion further comprises a lens coupling feature, wherein the lens coupling feature is configured to couple to a lens.

9. A luminaire comprising:

a housing comprising:

a central portion forming a substantially closed shape, wherein the central portion has a first width and a first height, wherein the substantially closed shape forms an inner area therewithin, wherein the inner area is open and traverses a height of the central portion, wherein the central portion is thermally conductive, and wherein the central portion comprises:

an upper end; and a lower end adjacent to the upper end, wherein the lower end comprises at least one light engine assembly coupling feature; and a plurality of fins thermally coupled to and extending inward and outward away from the upper end of the central portion, wherein the plurality of fins are thermally conductive, wherein the plurality of fins extending inward are disposed within the inner area, wherein each fin of the plurality of fins has a second width and a second height;

at least one light engine assembly mechanically coupled to the lower end of the central portion using the at least one light engine assembly coupling feature, wherein the at least one light engine assembly comprises at least one light board and at least one light source; and at least one electrical conductor electrically coupled to the at least one light engine assembly, wherein the second width is greater than the first width, wherein the second height is greater than the first height, wherein the central portion is positioned substantially halfway along the second width of the plurality of fins, wherein the central portion and the plurality of fins induce natural air flow therethrough, wherein the natural air flow removes heat from the central portion and the plurality of fins without using an air moving device, wherein the natural air flow moves unimpeded through the plurality of fins within the inner area at least to the first height of the central portion, and wherein a bottom inner end of the plurality of fins avoid contact with each other and with another component of the luminaire.

10. The luminaire of claim 9, wherein the central portion further comprises:

a power transfer coupling feature disposed in the upper end of the central portion of the housing, wherein the at least one electrical conductor is coupled to the power transfer coupling feature.

11. The luminaire of claim 9, further comprising:

at least one sealing member positioned within at least one channel disposed in the lower end of the central portion, wherein the at least one sealing member is adjacent to the at least one light engine assembly.

12. The luminaire of claim 9, further comprising:

a lens mechanically coupled to a lens coupling feature of the central portion of the housing.

13. The luminaire of claim 9, further comprising:

a bracket coupled to the central portion of the housing and traversing at least some of the inner area of the substantially closed shape when viewed from above, wherein the bracket comprises a mounting feature configured to couple the bracket to an external mounting object.

14. The luminaire of claim 13, further comprising:

a power converter mechanically coupled to a power converter coupling feature of the bracket, wherein the power converter is thermally coupled to the plurality of fins, and wherein the power converter is electrically coupled to the at least one electrical conductor.

15. The luminaire of claim 14, wherein the bracket is non-linear when viewed from a side, having a raised center portion relative to either end of the bracket, wherein the power converter is mechanically coupled to the raised center portion of the bracket.

16. The luminaire of claim 13, further comprising:

a mounting feature disposed within the bracket, wherein the mounting feature is configured to couple to a mounting component.

17. The luminaire of claim 16, wherein the mounting feature comprises at least one wall forming a cavity therein, wherein the at least one electrical conductor is disposed within the cavity of the mounting feature.

18. The luminaire of claim 9, wherein the housing and the at least one light engine assembly are used in a hazardous environment.

19. The luminaire of claim 9, wherein ambient air flows through the plurality of fins and through the inner area along the height of the central portion.

20. A housing for a luminaire, comprising:

a central portion forming a substantially closed shape, wherein the substantially closed shape forms an inner area therewithin, wherein the inner area is open and traverses a height of the central portion, wherein the central portion is thermally conductive, and wherein the central portion comprises:

an upper end; and a lower end adjacent to the upper end, wherein the lower end comprises at least one light engine assembly coupling feature that is configured to couple to at least one light engine assembly; and a plurality of fins thermally coupled to and extending inward and outward away from the upper end of the central portion, wherein the upper end of the central portion overlaps the plurality of heat sink fins, wherein the plurality of fins are thermally conductive, wherein the plurality of fins extending inward are disposed within the inner area, wherein the central portion and the plurality of fins induce natural air flow therethrough, wherein the natural air flow removes heat from the central portion and the plurality of fins without using an air moving device, and wherein a bottom inner end of the plurality of fins avoid contact with each other and with another component of the housing.

* * * * *